US005089038A

United States Patent [19]

Kopco et al.

[11] Patent Number: 5,089,038

[45] Date of Patent: Feb. 18, 1992

[54] BAG MOUNT ASSEMBLY FOR A VACUUM CLEANER

[75] Inventors: James J. Kopco, Richmond Heights; Craig M. Saunders, Rocky River, both of Ohio

[73] Assignee: Royal Appliance Mfg. Co., Cleveland, Ohio

[21] Appl. No.: 714,356

[22] Filed: Jun. 12, 1991

Related U.S. Application Data

[63] Continuation of Ser. No. 441,708, Nov. 27, 1989, abandoned.

[51] Int. Cl.[5] ..... B01D 46/00

[52] U.S. Cl. ..... 55/374; 55/378

[58] Field of Search ..... 55/374, 378

[56] References Cited

U.S. PATENT DOCUMENTS

| | | | |
|---|---|---|---|
| 1,949,052 | 2/1934 | Kirby | 55/370 |
| 2,335,428 | 11/1943 | Lofgren | 55/467 |
| 2,643,733 | 6/1953 | Shellman | 55/418 |
| 2,719,600 | 10/1955 | Brace | 55/374 |
| 2,755,883 | 7/1956 | Brace | 55/378 |
| 2,870,863 | 1/1959 | Bramhall | 55/376 |
| 2,876,481 | 3/1959 | Gerber et al. | 15/331 |
| 2,961,688 | 11/1960 | Descarries | 15/323 |
| 3,023,447 | 3/1962 | Senne | 55/378 |
| 3,616,622 | 11/1971 | Friedman | 55/376 |
| 3,675,268 | 7/1972 | Nordeen | 15/350 |
| 3,683,599 | 8/1972 | Malz | 55/376 |
| 4,044,421 | 8/1977 | Kristenson et al. | 15/339 |
| 4,257,789 | 3/1981 | Leinfelt | 55/378 |
| 4,262,384 | 4/1981 | Bowers | 15/328 |
| 4,381,192 | 4/1983 | Grimard | 55/376 |
| 4,446,594 | 5/1984 | Watanabe et al. | 15/323 |
| 4,514,200 | 4/1988 | Sumerau et al. | 55/368 |
| 4,591,369 | 5/1986 | Stewart, Sr. et al. | 55/374 |
| 4,678,486 | 7/1987 | Jacob et al. | 55/374 |
| 4,738,697 | 4/1988 | Westergren | 55/376 |
| 4,936,883 | 6/1990 | Larsson et al. | 55/374 |

FOREIGN PATENT DOCUMENTS

| | | | |
|---|---|---|---|
| 3407658 | 9/1985 | Fed. Rep. of Germany | 55/378 |
| 2572640 | 5/1986 | France | 55/378 |

*Primary Examiner*—Jay H. Woo
*Assistant Examiner*—C. Scott Bushey
*Attorney, Agent, or Firm*—Fay, Sharpe, Beall, Fagan, Minnich & McKee

[57] ABSTRACT

A bag mount assembly for a vacuum cleaner includes a vacuum cleaner housing including an air inlet and a mounting plate which is pivotably mounted to the housing in relation to the air inlet. The mounting plate includes a planar body and a channel extending from one edge of the body. The channel is adapted to selectively hold a reinforced collar of an associated vacuum cleaner bag. In this way, the vacuum cleaner bag can be selectively connected to the air inlet or be rotated away therefrom in order to facilitate the changing of the bag.

18 Claims, 2 Drawing Sheets

BAG MOUNT ASSEMBLY FOR A VACUUM CLEANER

This is a continuation of copending application Ser. No. 07/441,708 filed on Nov. 27, 1989 now abandoned.

BACKGROUND OF THE INVENTION

This invention relates to vacuum cleaners. More particularly, the invention relates to vacuum cleaners having a removable dirt collection filter bag which is carried in a housing of the vacuum cleaner.

There are three types of powered upright vacuum cleaners which are in use today. A first type employs a soft, flexible, cloth dirt-catching bag which has an open weave such that air is permitted to pass through the bag while the dirt that is picked up by the vacuum cleaner remains in the bag. When the bag is sufficiently full, it is emptied into a suitable container or receptacle and the bag is then re-attached to the vacuum cleaner. A second type of upright vacuum cleaner uses a disposable air permeable paper bag that is held in a fabric outer bag which is permeable to permit free passage of air from the paper bag. One technique of connecting the bag to a blower outlet is to secure the bag over a tube leading from the blower outlet and then roll a rubber sleeve or a metallic band onto the neck of the bag to hold the bag in place. A third type of upright vacuum cleaner utilizes a hard box housing which has a sealed portion containing a disposable paper bag. The hard box upright vacuum cleaner is essentially a canister-type cleaner since the disposable bag is located upstream of the vacuum cleaner fan so that dirt is sucked into the bag rather than being propelled into it by the fan.

There are a number of disadvantages to each of these vacuum cleaner constructions in terms of easily disposing of dirt filled bags and replacing such bags with clean ones. One disadvantage of the flexible air permeable cloth bags is that the cleaning of the bag is a messy operation, especially if one is allergic to dust. The difficulty with disposable paper bags is that it is often a problem for a person to correctly secure an empty bag's mouth to the fill tube of the second type of upright vacuum cleaner or to an air inlet of the third type of upright vacuum cleaner. Also it is sometimes difficult to detach a full bag from either type of vacuum cleaner without spilling its contents.

Accordingly, it has been considered desirable to develop a new and improved vacuum cleaner bag mount assembly which would overcome the foregoing difficulties and others while providing better and more advantageous overall results.

BRIEF SUMMARY OF THE INVENTION

In accordance with one aspect of the present invention, a new and improved bag mount assembly for a vacuum cleaner is provided.

More particularly in accordance with this aspect of the invention, the bag mount assembly comprises a vacuum cleaner housing having an air inlet and a mounting plate. The mounting plate comprises a planar body and a channel extending from one edge of the body. The channel is adapted to selectively hold a reinforced collar of an associated vacuum cleaner bag. A pivot means is provided for pivotably mounting the mounting plate to the housing in relation to the air inlet.

In accordance with another aspect of the invention, a vacuum cleaner bag assembly is provided for an upright vacuum cleaner.

More particularly in accordance with this aspect of the invention, the assembly comprises a vacuum cleaner housing and a substantially rectangular mounting plate adapted to selectively hold a reinforced collar of an associated vacuum cleaner bag. A pivot means is provided for pivotably mounting the mounting plate to the housing. A latch means is provided for releasably securing the mounting plate to the housing in one end position.

In accordance with still another aspect of the invention, a vacuum cleaner bag assembly is provided.

More particularly in accordance with this aspect of the invention, the assembly comprises a vacuum cleaner housing, an air inlet pipe secured to the housing and a dust bag for receiving and retaining debris. The dust bag has a reinforced collar. A coupling means is provided for selectively placing an inlet of the dust bag in fluid communication with the air inlet pipe. The coupling means comprises a mounting plate for selectively holding the reinforced collar of the dust bag, a pivot means for pivotably mounting the mounting plate to the housing and a latch means for selectively latching the mounting plate in one end position.

One advantage of the present invention is the provision of a dust bag new and improved bag mount assembly for a vacuum cleaner.

Another advantage of the present invention is the provision of a dust bag mounting plate which is pivotably secured to a vacuum cleaner housing so that it can be moved between a bag emptying position and a bag use position.

Still another advantage of the present invention is the provision of a securing means for a vacuum cleaner bag mounting plate to allow the plate to be selectively latched in a bag use position to a housing of the vacuum cleaner.

Yet another advantage of the present invention is the provision of a dust bag mounting plate with an obstruction means for limiting a pivoting motion of the plate in relation to a housing of the vacuum cleaner.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figures 1, 3:
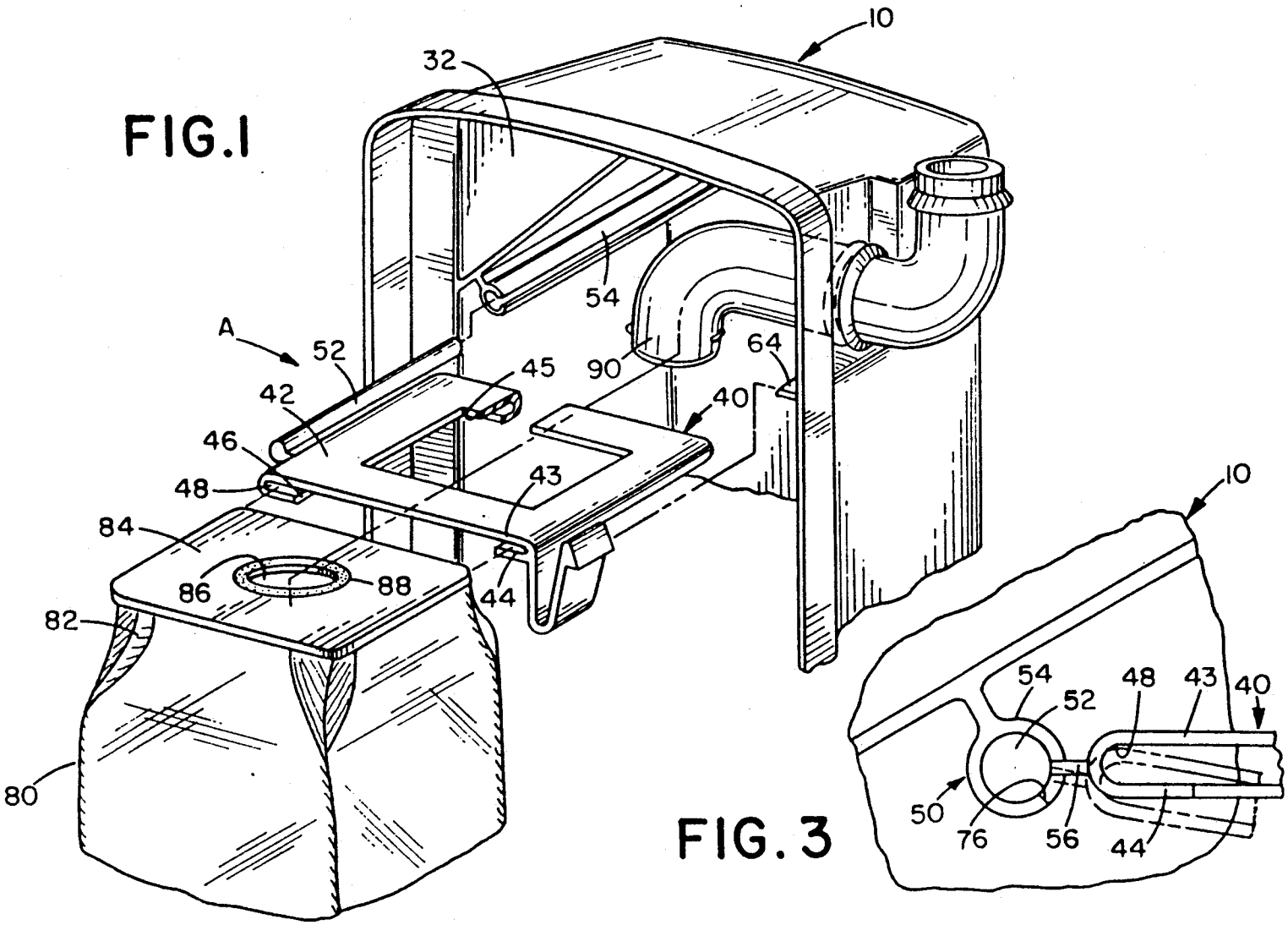
FIG. 1, is an exploded perspective view of a bag mount assembly for a vacuum cleaner according to the preferred embodiment of the present invention.

Referring now to the drawings wherein the showings are for purposes of illustrating a preferred embodiment of the invention and not for purposes of limiting same, FIG. 1 shows the preferred embodiment of a bag mount assembly for a vacuum cleaner A. While the bag mount assembly is primarily designed for and will hereinafter be described in connection with a particular type of vacuum cleaner, namely a hard box upright vacuum cleaner, it should be appreciated that the overall inventive concept involved could be adapted for use in many other cleaning or filtration environments as well.

Figures 2, 3:
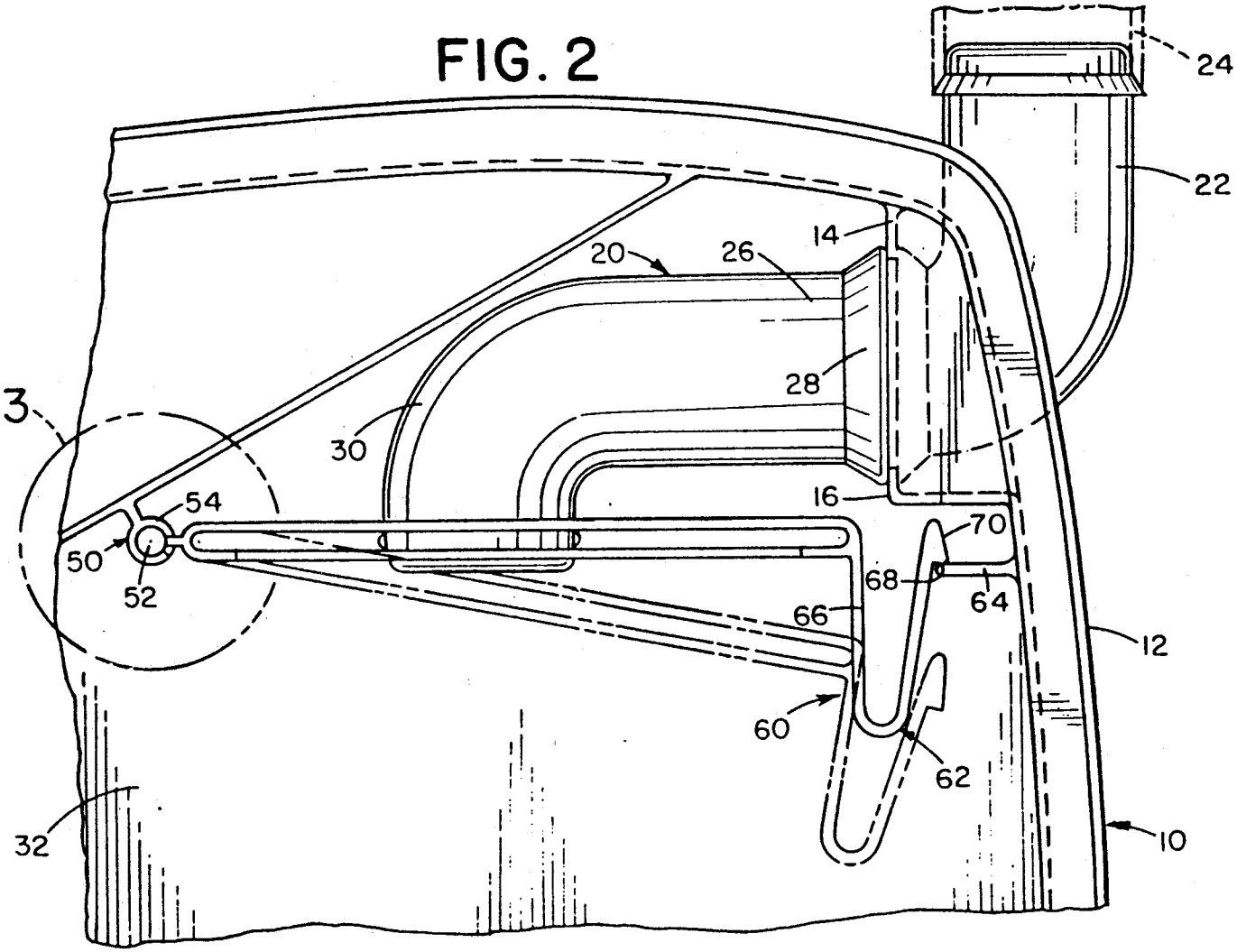
FIG. 2 is an enlarged side elevational view in assembled form of the vacuum cleaner bag mount assembly of FIG. 1; and, FIG. 3 is an enlarged view of a portion of the assembly of FIG. 2.

More particularly, FIG. 2 shows a vacuum cleaner housing 10 with an exterior wall 12, and an indented section 14 having an inner surface 16. Extending through the indented wall section 14 is an air inlet or fill tube 20 which has a first or outer end 22 that is adapted to seat an end of a vacuum hose 24. A central portion 26 of the air inlet 20 extends through and is secured to the indented wall section 14 by a securing structure 28. An inner end 30 of the air inlet extends into the housing 10 and terminates in a chamber 32 defined in the housing 10.

With reference now to FIG. 1, a mounting plate 40 is housed in the chamber 32. The mounting plate preferably has a planar body 42 that can be approximately rectangular in form and which is defined by a pair of spaced parallel walls 43 and 44 which are secured at their outer periphery to each other to form U-shaped edges for the plate. Extending through the first wall 43 is a through opening 45 which is substantially rectangular in form. Defined in the second wall 44 is a U-shaped opening 46 which is larger than the through opening 45.

Surrounding the opening 46 is a channel 48 which is defined by connected edges of the walls 43 and 44. The channel is U-shaped in that it has two legs extending along two sides of the plate and a base extending along a lower end of the plate. The channel is also U-shaped in cross-section.

As best shown in FIG. 3, a hinge means 50 secures the mounting plate 40 to the housing 10. The hinge means comprises a hinge pivot pin 52 which is formed along the one side edge of the plate 40 in spaced relation to the walls 43 and 44 well as the channel 48. Cooperating with the pivot pin is a hinge barrel 54, which is secured to the housing inner wall. The hinge barrel 54 is preferably C-shaped to allow for a mounting plate flat section 56 adjacent the pivot pin 52 to connect the pin to the rest of the plate. It can be seen that the hinge barrel 54 is oriented substantially horizontally in order to allow the mounting plate 40 to pivot around the pivot pin 52 due to the force of gravity.

With reference again to FIG. 2, in order to secure the mounting plate 40 in one end position in relation to the air inlet 20, a latch means 60 is provided. The latch means comprises a finger 62 which is defined on the mounting plate 40 and a tab or ear 64 which is secured to the housing inner surface. Preferably, the finger 62 is formed integrally with the mounting plate which is preferably made of a suitable plastic material, such as polypropylene for this purpose. The finger can comprise a U-shaped resilient portion 66, a latch face 68 which is located on a free end of resilient portion, and is adapted to contact an upper face of the ear 64, and a digit portion 70. The digit portion is adapted to be contacted by a finger of the user in order to remove the latch face 68 from contact with the ear 64 through the pivoting of the finger 62 around the U-shaped resilient body 66.

In order to limit the pivoting motion of the mounting plate 40 in relation to the housing 10, an obstruction means can be provided. With reference again to FIG. 3, preferably the obstruction means comprises the interaction of the mounting plate flat section 56 with a lower face 76 of the C-shaped hinge barrel 54 as shown in FIG. 2. The obstruction means prevents the pivoting of the mounting plate 40 downwardly away from the air inlet 20 past a certain point by an abutment of the flat section 56 against the lower face 76 of the hinge barrel 54. Preferably, the housing 10 is formed from a suitable plastic material so that the hinge barrel 54 and ear 64 can both be formed integrally with the housing.

Adapted to be mounted to the mounting plate 40 is a dust bag 80 having a first end 82 provided with a reinforced collar 84. The collar 84 can be slipped into the channel 48 of the plate 40. Centrally located in the collar is an aperture 86 which preferably has a lip 88 of a suitable sealing material so that the bag 80 can cooperate with a sealing face 90 of the air inlet 20.

With the present invention, the bag 80 can be placed in sealed communication with the air inlet 20 in order to prevent dust particles from flying out of the air inlet 20 and into the housing 10. When the bag 80 is full, however, it can be easily removed from the chamber 30 by undoing the latch means 60 thereby allowing the mounting plate 40 to pivot around the hinge means 50 due to the force of gravity as far as is permitted by the obstruction means 76. Thereafter, the dust bag reinforced collar 84 can be slid out of the mounting plate channel 48 and the dust bag can be suitably disposed of. When this has been done, a suitable new dust bag can be slid into place in the channel 46 and the mounting plate can again be pivoted upwardly around the hinge means 50 until the latch means 60 is engaged. At this point, the new dust bag is available for use in the vacuum cleaner.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described the preferred embodiments the invention is claimed as follows:

1. A bag mount assembly for a vacuum cleaner comprising:
   - a rigid vacuum cleaner housing forming a chamber for holding an associated vacuum cleaner bag, said housing having an air inlet wherein said air inlet comprises a pipe extending through a stationary portion of said housing;
   - a mounting plate comprising:
     - a planar body, and
     - a channel extending from one edge of said body, said channel selectively holding a reinforced collar of the associated vacuum cleaner bag; and,
     - a pivot means for pivotably mounting said mounting plate in said chamber to a stationary portion of said housing adjacent said pipe to enable the associated vacuum cleaner bag to cooperate with said pipe in one end position of said mounting plate.

2. The assembly of claim 1 further comprising an obstruction means for limiting a range of motion of said mounting plate away from said air inlet.

3. The assembly of claim 1 wherein said pivot means comprises:
   - a first hinge member secured to said housing; and,
   - a second hinge member secured to said mounting plate and cooperating with said first hinge member.

4. The assembly of claim 3 wherein said first hinge member comprises a C-shaped hinge barrel, and wherein said second hinge member comprises a pivot pin extending along one edge of said mounting plate.

5. The assembly of claim 1 further comprising a latch means for releasably securing said mounting plate in one end position in relation to said air inlet.

6. The assembly of claim 5 wherein said latch means comprises:

a resilient finger which is integral with said mounting plate and is located adjacent one edge thereof; and, an ear provided on said housing and cooperating with said resilient finger to secure said mounting plate in said one end position.

7. A vacuum cleaner bag assembly for an upright vacuum cleaner comprising:

a rigid vacuum cleaner housing for selectively enclosing an associated vacuum cleaner bag;

a substantially rectangular mounting plate selectively holding a reinforced collar of the associated vacuum cleaner bag;

a pivot means for pivotably mounting said mounting plate to an inner wall of said rigid housing; and, a latch means for releasably securing said mounting plate to said rigid housing in one end position, said latch means including a first element integral with said mounting plate and a second element integral with a stationary portion of said rigid housing.

8. The assembly of claim 7 wherein said pivot means comprises:

a C-shaped hinge barrel secured to said housing; and, a pivot pin extending along one edge of said mounting plate.

9. The assembly of claim 7 wherein said latch means first element comprises a resilient finger and wherein said latch means second element comprises an ear member which is secured to an inner wall of said housing so as to cooperate with said resilient finger.

10. The assembly of claim 7 further comprising an obstruction means for limiting a range of motion of said mounting plate.

11. The assembly of claim 7 further comprising an air inlet pipe secured to said housing and mounted so as to have one end extend into said housing and contact said associated vacuum cleaner bag when said mounting plate is in a locked position.

12. The assembly of claim 7 wherein said mounting plate further comprises a channel portion selectively receiving and holding said reinforced collar of the associated vacuum cleaner bag.

13. The assembly of claim 12 wherein said mounting plate channel portion extends along three edges of said mounting plate.

14. A vacuum cleaner bag assembly comprising:

an air-impervious vacuum cleaner housing forming a box-like chamber;

an air inlet pipe secured to a stationary portion of said housing and extending into said chamber;

a dust bag for receiving and retaining debris, said dust bag being selectively held in said chamber and having a reinforced collar; and, a coupling means, located in said chamber, for selectively placing an inlet of said dust bag in fluid communication with said air inlet pipe, said coupling means comprising:

a mounting plate having a channel for selectively holding said reinforced collar of said dust bag, a pivot means for pivotably mounting said mounting plate to said housing, and a latch means for selectively latching said mounting plate in one end position, said latch means including a member secured to said housing and located in said chamber.

15. The assembly of claim 14 further comprising an obstruction means for limiting a range of motion of said mounting plate away from said air inlet pipe.

16. The assembly of claim 14 wherein said pivot means comprises:

a first hinge member secured to said housing; and a second hinge member secured to said mounting plate.

17. The assembly of claim 14 wherein said first hinge member comprises a C-shaped hinge barrel, and said second hinge member comprises a hinge pin.

18. The assembly of claim 14 wherein said latch means comprises:

a resilient finger located on said mounting plate; and, wherein said member secured to said housing comprises an ear which selectively cooperates with said finger.

* * * * *